US005839612A

United States Patent [19]

Burke

[11] Patent Number: 5,839,612

[45] Date of Patent: Nov. 24, 1998

[54] CAULKING DISPENSING DRILL ATTACHMENT

[76] Inventor: Glendal Roy Burke, 199 Johnny Rigney Rd., State Line, Miss. 39362

[21] Appl. No.: 74,090

[22] Filed: May 7, 1998

[51] Int. Cl.[6] ..... B67D 5/46

[52] U.S. Cl. ..... 222/333; 222/390

[58] Field of Search ..... 222/326, 327, 222/333, 390

[56] References Cited

U.S. PATENT DOCUMENTS

| | | | |
|---|---|---|---|
| 1,776,659 | 9/1930 | Geffon et al. | 222/333 X |
| 1,829,789 | 11/1931 | Dammeyer | 222/333 |
| 3,208,638 | 9/1965 | Frenzel et al. | 222/333 X |
| 3,254,806 | 6/1966 | Madsen | 222/333 X |
| 3,389,838 | 6/1968 | Morra et al. | 222/326 X |
| 3,635,378 | 1/1972 | DeHart | 222/333 |
| 3,854,629 | 12/1974 | Blieberger | 222/333 X |
| 3,861,567 | 1/1975 | Davis, Jr. | 222/333 |
| 3,985,273 | 10/1976 | Davis, Jr. | 222/333 X |
| 4,180,187 | 12/1979 | Ben-Haim | 222/390 X |
| 4,258,866 | 3/1981 | Bergman | 222/390 X |
| 4,306,671 | 12/1981 | Fisher | 222/333 X |
| 4,322,022 | 3/1982 | Bergman | 222/333 X |
| 4,335,834 | 6/1982 | Zepkin | 222/390 X |
| 5,027,984 | 7/1991 | Gakhar et al. | 222/390 X |
| 5,058,781 | 10/1991 | Aronie et al. | 222/390 X |
| 5,353,971 | 10/1994 | Vaziri | 222/333 X |
| 5,556,009 | 9/1996 | Motzko | 222/333 X |
| 5,762,239 | 6/1998 | Cossette | 222/333 X |

*Primary Examiner*—Kevin P. Shaver

[57] ABSTRACT

A mechanized caulking material dispensing device is provided including a caulking tube having a cylinder with a front end face having a nozzle formed thereon. A rear end face of the cylinder is slidably situated within the cylinder for dispensing caulking material from the nozzle upon the insertion of the rear end face within the cylinder. A caulking tube mounting handle is coupled to the cylinder and has a grip mounted thereon. Also included is a drill having an elongated threaded drill bit with an inboard end releasably coupled to a motor of the drill. An outboard end of the drill bit abuts the rear face of the caulking tube. Further, an intermediate extent of the drill bit is threadedly engaged with a threaded aperture of the caulking tube mounting handle for inserting the rear face of the caulking tube into the cylinder upon the actuation of the motor of the drill by way of a trigger.

6 Claims, 2 Drawing Sheets

CAULKING DISPENSING DRILL ATTACHMENT

BACKGROUND OF THE INVENTION

1. Field of the Invention

The present invention relates to caulking dispensers and more particularly pertains to a new caulking dispensing drill attachment for dispensing caulking material from a caulking tube with a conventional drill.

2. Description of the Prior Art

The use of caulking dispensers is known in the prior art. More specifically, caulking dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art caulking dispensers include U.S. Pat. No. 5,027,984; U.S. Pat. No. 3,985,273; U.S. Pat. No. 3,861,567; U.S. Pat. No. 4,376,498; U.S. Pat. No. 3,389,838; and U.S. Pat. No. 3,411,213.

In these respects, the caulking dispensing drill attachment according to the present invention substantially departs from the conventional concepts and designs of the prior art, and in so doing provides an apparatus primarily developed for the purpose of dispensing caulking material from a caulking tube with a conventional drill.

SUMMARY OF THE INVENTION

In view of the foregoing disadvantages inherent in the known types of caulking dispensers now present in the prior art, the present invention provides a new caulking dispensing drill attachment construction wherein the same can be utilized for dispensing caulking material from a caulking tube with a conventional drill.

The general purpose of the present invention, which will be described subsequently in greater detail, is to provide a new caulking dispensing drill attachment apparatus and method which has many of the advantages of the caulking dispensers mentioned heretofore and many novel features that result in a new caulking dispensing drill attachment which is not anticipated, rendered obvious, suggested, or even implied by any of the prior art caulking dispensers, either alone or in any combination thereof.

To attain this, the present invention generally comprises a caulking tube having a cylinder with a front end face having a nozzle formed thereon. A rear end face of the cylinder is slidably situated within the cylinder for dispensing caulking material from the nozzle upon the insertion of the rear end face within the cylinder. A caulking tube mounting handle is provided including a ergonomically shaped grip with a bore formed therein adjacent to a top thereof. Note FIG. 1. A mount is integrally coupled to the top of the grip. Such mount includes a rear circular plate and a tubular side wall integrally coupled to the rear plate and extending forwardly therefrom for defining a recess. The recess serves to releasably receive a rear end of the caulking tube. With reference to FIG. 1, the mount further has a threaded aperture formed in a central extent thereof about an axis which resides in parallel with that associated with the bore. Such axis further remains in perpendicular relationship with the grip. Also included is a drill having an L-shaped configuration. As such, the drill is equipped with an upper extent having a motor mounted therein. A lower extent of the drill takes the shape of a gripping member with a trigger. The drill has an elongated threaded drill bit with an inboard end releasably coupled to the motor of the drill. An outboard end communicates with the rear face of the caulking tube. In use, an intermediate extent of the drill bit is threadedly engaged with the threaded aperture of the caulking tube mounting handle. By this structure, the drill bit is adapted for inserting the rear face of the caulking tube into the cylinder upon the actuation of the motor by way of the trigger. For precluding the caulking tube mounting handle from rotating with respect to the drill, a guide assembly is provided. The guide assembly includes a clamp having an annular configuration with a top end split to define a pair of ends having a pair of upwardly extending tabs integrally coupled thereto. A pair of aligned bores are formed in such tabs for coupling the clamp about the upper extent of the drill via a bolt. As shown in FIG. 4, the clamp further includes a rectangular member integrally coupled to a lower end of the clamp with a hole formed therein. A guide rod of the guide assembly has an inboard end coupled within the hole of the clamp, as shown in FIG. 3. An outboard end of the guide rod of the guide assembly is slidably inserted within the bore of the grip of the caulking tube mounting handle. Note FIG. 1.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new caulking dispensing drill attachment apparatus and method which has many of the advantages of the caulking dispensers mentioned heretofore and many novel features that result in a new caulking dispensing drill attachment which is not anticipated, rendered obvious, suggested, or even implied by any of the prior art caulking dispensers, either alone or in any combination thereof.

It is another object of the present invention to provide a new caulking dispensing drill attachment which may be easily and efficiently manufactured and marketed.

It is a further object of the present invention to provide a new caulking dispensing drill attachment which is of a durable and reliable construction.

An even further object of the present invention is to provide a new caulking dispensing drill attachment which is susceptible of a low cost of manufacture with regard to both materials and labor, and which accordingly is then susceptible of low prices of sale to the consuming public, thereby making such caulking dispensing drill attachment economically available to the buying public.

Still yet another object of the present invention is to provide a new caulking dispensing drill attachment which provides in the apparatuses and methods of the prior art some of the advantages thereof, while simultaneously overcoming some of the disadvantages normally associated therewith.

Still another object of the present invention is to provide a new caulking dispensing drill attachment for dispensing caulking material from a caulking tube with a conventional drill.

Even still another object of the present invention is to provide a new caulking dispensing drill attachment that includes a caulking tube having a cylinder with a front end face having a nozzle formed thereon. A rear end face of the cylinder is slidably situated within the cylinder for dispensing caulking material from the nozzle upon the insertion of the rear end face within the cylinder. A caulking tube mounting handle is coupled to the cylinder and has a grip mounted thereon. Also included is a drill having an elongated threaded drill bit with an inboard end releasably coupled to a motor of the drill. An outboard end of the drill bit abuts the rear face of the caulking tube. Further, an intermediate extent of the drill bit is threadedly engaged with a threaded aperture of the caulking tube mounting handle for inserting the rear face of the caulking tube into the cylinder upon the actuation of the motor of the drill by way of a trigger.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
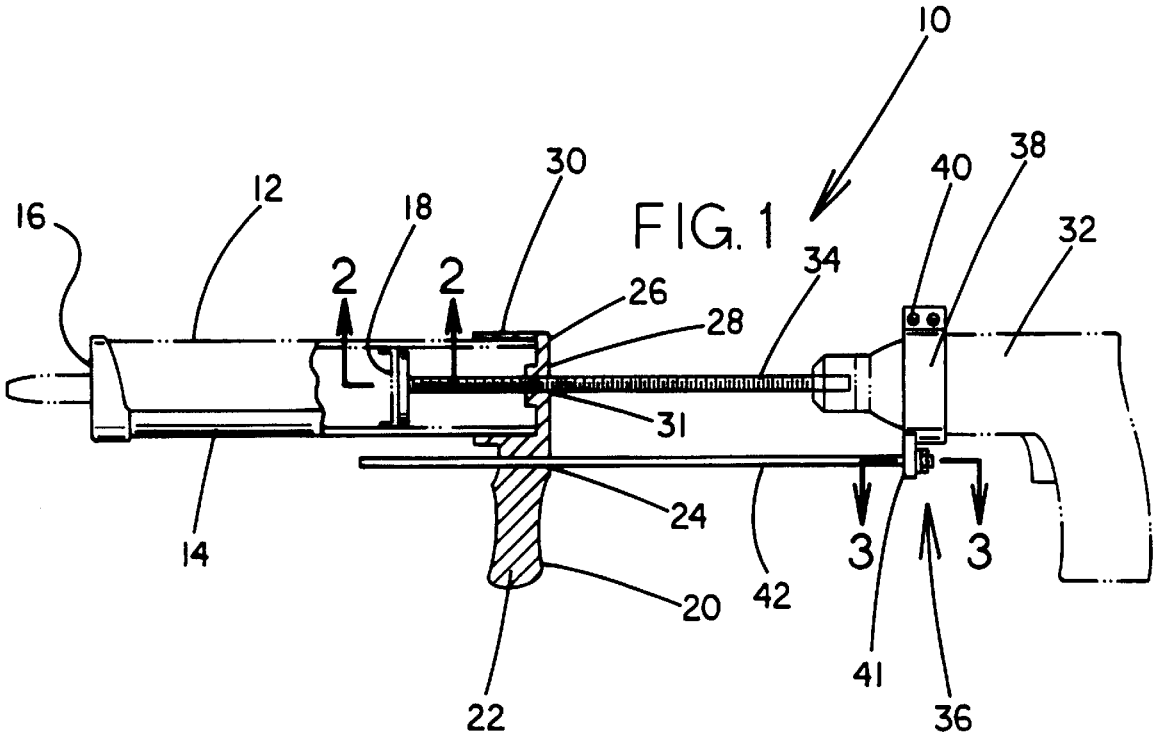
FIG. 1 is a side view of a new caulking dispensing drill attachment according to the present invention.
Figure 2:
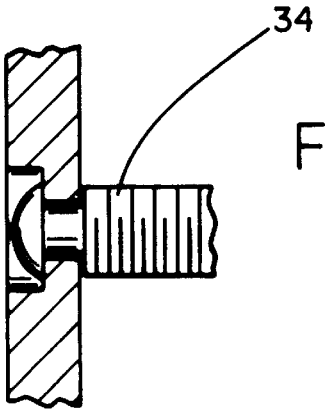
FIG. 2 is a cross-sectional view of the present invention taken along line 2—2 shown in FIG. 1.

With reference now to the drawings, and in particular to FIGS. 1 through 4 thereof, a new caulking dispensing drill attachment embodying the principles and concepts of the present invention and generally designated by the reference numeral 10 will be described.

The present invention, designated as numeral 10, includes a caulking tube 12 having a hollow cylinder 14 with a front end face 16 having a nozzle formed thereon. A rear end face 18 of the cylinder is slidably situated within the cylinder for dispensing caulking material from the nozzle upon the insertion of the rear end face within the cylinder.

A caulking tube mounting handle 20 is provided including a ergonomically shaped grip 22 with a bore 24 formed therein adjacent to a top thereof. Note FIG. 1. A mount 26 is integrally coupled to the top of the grip. Such mount includes a rear circular plate 28 and a tubular side wall 30 integrally coupled to the rear plate and extending forwardly therefrom for defining a recess. The recess serves to releasably receive a rear end of the caulking tube. The side wall preferably encompasses at least 1/10 of the cylinder to afford a suitable coupling. With reference to FIG. 1, the mount further has a threaded aperture 31 formed in a central extent thereof about an axis which resides in parallel with that associated with the bore. Such axis further remains in perpendicular relationship with the grip.

Also included is a drill 32 having an L-shaped configuration. The drill is thus equipped with an upper extent having a motor mounted therein. A lower extent of the drill takes the shape of a gripping member with a trigger. The drill has an elongated threaded drill bit 34 with an inboard end releasably coupled to the motor of the drill. An outboard end of the drill bit has a circular plate rotatably mounted thereon for communicating with the rear face of the caulking tube. A length of the drill bit is at least that of the cylinder of the caulking tube. In use, an intermediate extent of the drill bit is threadedly engaged with the threaded aperture of the caulking tube mounting handle. By this structure, the drill bit is adapted for inserting the rear face of the caulking tube into the cylinder upon the actuation of the motor by way of the trigger.

Figure 3:
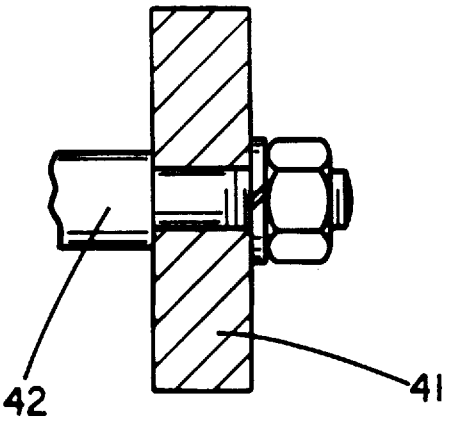
FIG. 3 is another cross-sectional view of the present invention taken along line 3—3 shown in FIG. 1.
Figure 4:
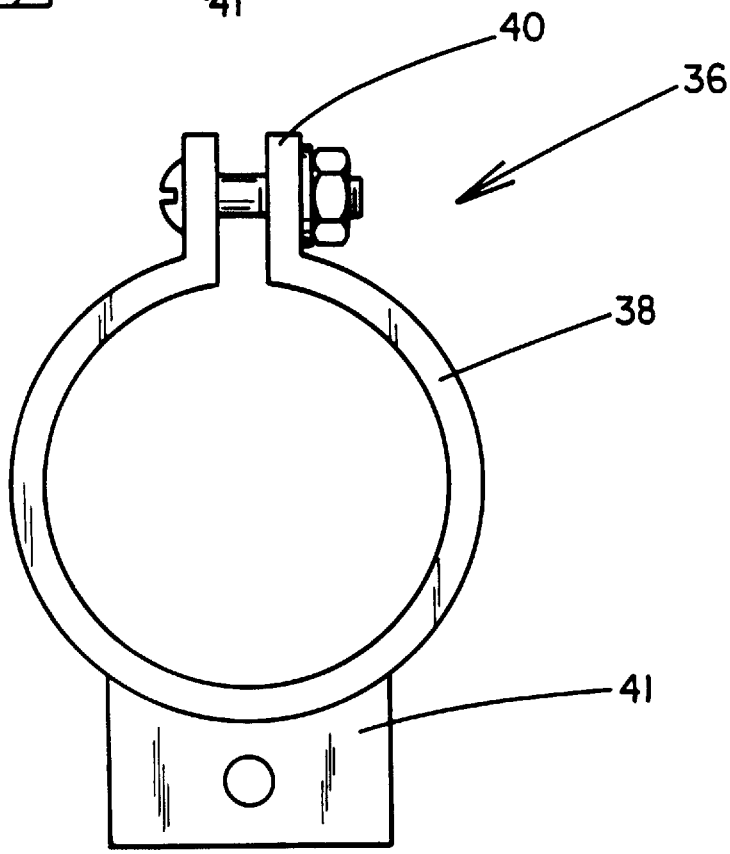
FIG. 4 is a front view of the clamp of the guide assembly of the present invention.

For precluding the caulking tube mounting handle from rotating with respect to the drill, a guide assembly 36 is provided. The guide assembly includes a clamp 38 having an annular configuration with a top end split to define a pair of ends. Such ends have a pair of upwardly extending tabs integrally coupled thereto. A pair of aligned bores are formed in such tabs 40 for coupling the clamp about the upper extent of the drill via a bolt. As shown in FIG. 4, the clamp further includes a rectangular member 41 integrally coupled to a lower end of the clamp with a hole formed therein. A guide rod 42 of the guide assembly has an inboard end coupled within the hole of the clamp, as shown in FIG. 3. An outboard end of the guide rod of the guide assembly is slidably inserted within the bore of the grip of the caulking tube mounting handle. Note FIG. 1. As shown in such Figure, the guide rod preferably has a length equal to that of the threaded drill bit.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mechanized caulking material dispensing device comprising, in combination:

a caulking tube including a cylinder with a front end face having a nozzle formed thereon and a rear end face slidably situated within the cylinder for dispensing caulking material from the nozzle upon the insertion of the rear end face within the cylinder;

a caulking tube mounting handle including a ergonomically shaped grip with a bore formed therein adjacent to a top thereof and a mount integrally coupled to the top of the grip, the mount including a rear circular plate and a tubular side wall integrally coupled to the rear plate and extending forwardly therefrom defining a recess for releasably receiving a rear end of the caulking tube, the mount having a threaded aperture formed in a central extent thereof about an axis which resides in parallel with that associated with the bore and further in perpendicular relationship with the grip;

a drill having an L-shaped configuration with an upper extent having a motor mounted therein and a lower extent taking the shape of a gripping member with a trigger, the drill having an elongated threaded drill bit having an inboard end releasably coupled to the motor of the drill, an outboard end abutting the rear face of the caulking tube, and an intermediate extent threadedly engaged with the threaded aperture of the caulking tube mounting handle for inserting the rear face of the caulking tube into the cylinder upon the actuation of the motor by way of the trigger; and a guide assembly including a clamp having an annular configuration with a top end split to define a pair of ends having a pair of upwardly extending tabs integrally coupled thereto with a pair of aligned bores formed therein for coupling the clamp about the upper extent of the drill via a bolt, the clamp further including a rectangular member integrally coupled to a lower end of the clamp with a hole formed therein, wherein a guide rod of the guide assembly has an inboard end coupled within the hole of the clamp and an outboard end slidably inserted within the bore of the grip of the caulking tube mounting handle for precluding the caulking tube mounting handle from rotating with respect to the drill.

2. A mechanized caulking material dispensing device for use with a conventional drill comprising:

a caulking tube including a cylinder with a front end face having a nozzle formed thereon and a rear end face slidably situated within the cylinder for dispensing caulking material from the nozzle upon the insertion of the rear end face within the cylinder;

a caulking tube mounting handle releasably coupled to the cylinder and having a grip mounted thereon; and a drill having an elongated threaded drill bit having an inboard end releasably coupled to a motor of the drill, an outboard end abutting the rear face of the caulking tube, and an intermediate extent threadedly engaged with a threaded aperture of the caulking tube mounting handle for inserting the rear face of the caulking tube into the cylinder upon the actuation of the motor of the drill by way of a trigger.

3. A mechanized caulking material dispensing device as set forth in claim 2 wherein the drill is L-shaped.

4. A mechanized caulking material dispensing device as set forth in claim 2 wherein the caulking tube mounting handle includes a mount with a recess for releasably receiving a rear end of the cylinder of the caulking tube.

5. A mechanized caulking material dispensing device as set forth in claim 2 and further including a guide assembly including a guide rod coupled to the drill and slidably received within the caulking tube mounting handle, wherein the guide rod remains in parallel relationship with the threaded drill bit.

6. A mechanized caulking material dispensing device as set forth in claim 5 wherein the guide assembly is removably coupled to the drill.

* * * * *